US009175236B2

(12) United States Patent
Van Houten

(10) Patent No.: US 9,175,236 B2
(45) **Date of Patent: *Nov. 3, 2015**

(54) LUBRICATING OIL COMPOSITION AND METHOD FOR USE WITH LOW SULFUR MARINE RESIDUAL FUEL

(75) Inventor: Wilhelmus P. A. Van Houten, Prinsenbeek (NL)

(73) Assignee: CHEVRON ORONITE TECHNOLOGY B.V., Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/149,838

(22) Filed: May 8, 2008

(65) Prior Publication Data

US 2009/0281009 A1 Nov. 12, 2009

(51) Int. Cl.

| | |
|---|---|
| ***C10M 105/68*** | (2006.01) |
| ***C10M 105/78*** | (2006.01) |
| ***C10M 105/22*** | (2006.01) |
| ***C10M 105/28*** | (2006.01) |
| ***C10M 137/10*** | (2006.01) |
| ***C10M 129/54*** | (2006.01) |
| ***C10M 141/06*** | (2006.01) |
| ***C10M 141/12*** | (2006.01) |
| ***C10M 159/20*** | (2006.01) |
| ***C10M 163/00*** | (2006.01) |

(52) U.S. Cl.

CPC ..... *C10M 129/54* (2013.01); *C10M 141/06* (2013.01); *C10M 141/12* (2013.01); *C10M 159/20* (2013.01); *C10M 163/00* (2013.01); *C10M 2203/1006* (2013.01); *C10M 2207/144* (2013.01); *C10M 2207/146* (2013.01); *C10M 2207/262* (2013.01); *C10M 2215/28* (2013.01); *C10M 2223/045* (2013.01); *C10N 2220/021* (2013.01); *C10N 2230/04* (2013.01); *C10N 2230/041* (2013.01); *C10N 2230/10* (2013.01); *C10N 2230/43* (2013.01); *C10N 2230/52* (2013.01); *C10N 2240/102* (2013.01)

(58) Field of Classification Search

CPC ..... C10M 129/54; C10M 141/12; C10M 159/20; C10M 141/06; C10M 163/00; C10M 2207/262; C10M 2203/1006; C10M 2215/28; C10M 2207/144; C10M 2223/045; C10N 2230/10; C10N 2240/102; C10N 2230/04; C10N 2220/021; C10N 2230/43; C10N 2230/041

USPC ..... 508/459, 460, 42, 463, 518, 519, 287, 508/523, 586

See application file for complete search history.

(56) References Cited

U.S. PATENT DOCUMENTS

| | | | | |
|---|---|---|---|---|
| 4,627,928 | A * | 12/1986 | Karn | 508/460 |
| 6,521,571 | B1 * | 2/2003 | Garner et al. | 508/359 |
| 2002/0128160 | A1 * | 9/2002 | Dunn et al. | 508/482 |
| 2004/0235686 | A1 | 11/2004 | Boons et al. | |
| 2005/0137100 | A1 * | 6/2005 | Le Coent et al. | 508/518 |
| 2006/0052259 | A1 * | 3/2006 | Le Coent et al. | 508/460 |
| 2007/0027043 | A1 | 2/2007 | Le Coent | |

FOREIGN PATENT DOCUMENTS

| | | | |
|---|---|---|---|
| EP | 1016706 | A2 * | 7/2000 |
| EP | 1154012 | A2 | 11/2001 |
| EP | 1209218 | | 5/2002 |
| EP | 1486556 | A1 | 12/2004 |
| EP | 1790710 | A1 | 5/2007 |
| JP | 2005263861 | A * | 9/2005 |
| WO | WO 2006/064138 | | 6/2006 |

OTHER PUBLICATIONS

Evaluation of Low Sulfur Marine Fuel Availability—Pacific Rim (Jul. 2005).*

* cited by examiner

*Primary Examiner* — Pamela H Weiss
(74) *Attorney, Agent, or Firm* — Jones Day

(57) ABSTRACT

This invention describes novel trunk piston engine lubricating oil compositions for use in trunk piston engines operating on low sulfur marine residual fuels, as well as methods for lubricating trunk piston engines, methods of using the trunk piston lubricating oil compositions, and methods of making thereof.

12 Claims, No Drawings

LUBRICATING OIL COMPOSITION AND METHOD FOR USE WITH LOW SULFUR MARINE RESIDUAL FUEL

FIELD OF THE INVENTION

This invention relates to lubricating oil compositions and methods for lubricating a trunk piston engine, and more specifically relates to compositions and methods for lubricating trunk piston engines operating on low sulfur marine residual fuel.

BACKGROUND

Because of the complex demands for trunk piston lubricating oil compositions in lubricating all regions of trunk piston engines, much effort has been made to develop lubricating oil compositions that perform well with conventional high sulfur heavy fuel oils.

With increasing health and environmental concerns regarding the use of high sulfur heavy fuel oils, however, there is an increasing likelihood that low sulfur marine residual fuel use in trunk piston engines will become the norm, or even mandated.

While conventional lubricating oil compositions used, to this point, in trunk piston engines operating on conventional heavy fuel oils and diesel fuels might function to some degree with low sulfur marine residual fuels, they likely are ill-suited for such usage and would not ensure optimum performance, such as in neutralizing acid combustion gases, maintaining engine cleanliness, and resisting viscosity increase.

Some attempts have been made, therefore, to produce a lubricating oil composition for use with fuels with specified sulfur content. For example, EP 1486556 is directed to a method for lubricating crosshead marine diesel engines that operates on a fuel having a sulfur content of less than 1.5%, using a cylinder lubricant composition that comprises a detergent complex. Moreover, EP 1790710 is directed to a method for operating a marine engine by lubricating the engine with a single cylinder lubricant that comprises an overbased metal detergent. Moreover, WO/2006064138 is directed to a method for operating a marine four-stroke engine operating on fuels of varying sulfur content, which comprises lubricating the engine with a lubricating oil composition that contains a detergent.

A need still remains, however, for improved lubricating oil composition for use in low sulfur marine residual fuels that achieve optimum performance.

BRIEF SUMMARY OF THE INVENTION

In one aspect, the present invention relates to a trunk piston engine lubricating oil composition, comprising a major amount of a Group I base oil and/or a Group II base oil; and at least one salt of an alkyl-substituted hydroxybenzoic acid, wherein at least 90% of the alkyl groups are $C_{20}$ or greater, wherein the lubricating oil composition is a medium soap, or high soap formulation.

In another aspect, the present invention relates to a method for operating a trunk piston engine, comprising: (a) fueling the engine with a low sulfur marine residual fuel, and (b) lubricating the engine with a lubricating oil composition comprising at least one detergent comprising a salt of an alkyl-substituted hydroxybenzoic acid, wherein at least 90% of the alkyl groups are $C_{20}$ or greater.

In another aspect, the present invention relates to a method for lubricating a trunk piston engine operating on a low sulfur marine residual fuel comprising: lubricating the trunk piston engine with a lubricating oil composition comprising at least one detergent comprising a salt of an alkyl-substituted hydroxybenzoic acid, wherein at least 90% of the alkyl groups are $C_{20}$ or greater.

In another aspect, the present invention relates to a method for minimizing deposit formation in a trunk piston engine operating on a low sulfur marine residual fuel comprising: lubricating the trunk piston engine with a lubricating oil composition comprising at least one detergent comprising a salt of an alkyl-substituted hydroxybenzoic acid, wherein at least 90% of the alkyl groups are $C_{20}$ or greater.

Several embodiments of the invention, including the above aspects of the invention, are described in further detail as follows. Generally, each of these embodiments can be used in various and specific combinations, and with other aspects and embodiments unless otherwise stated herein.

DETAILED DESCRIPTION OF THE INVENTION

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

"A major amount" of an oil of lubricating viscosity refers to a concentration of the oil within the lubricating oil composition of at least about 40 wt. %. In some embodiments, "a major amount" of an oil of lubricating viscosity refers to a concentration of the oil within the lubricating oil composition of at least about 50 wt. %, at least about 60 wt. %, at least about 70 wt. %, at least about 80 wt. %, or at least about 90 wt. %.

A "low sulfur" fuel refers to a fuel having 1.5 wt. % or less of sulfur, such as fuels having 1.4 wt. % or less, 1.3 wt. % or less, 1.2 wt. % or less, 1.0 wt. % or less, 0.8 wt. % or less, 0.6 wt. % or less, or even 0.4 wt. % or less of sulfur, relative to the total weight of the fuel.

A "high sulfur" fuel refers to a fuel having greater than 1.5 wt. % of sulfur, relative to the total weight of the fuel.

A "marine residual fuel" refers to a material combustible in a marine trunk piston engine that has a carbon residue, as defined in International Organization for Standardization (ISO) 10370) of greater than 2.50 wt. % (relative to the total weight of the fuel), a viscosity at 50° C. of greater than 14.0 cSt, and a micro carbon residue of at least 2.5 wt. % (e.g., at least 5 wt. %, or at least 8 wt. %) (relative to the total weight of the fuel), such as the marine residual fuels defined in the International Organization for Standardization specification ISO 8217:2005, "Petroleum products—Fuels (class F)—Specifications of marine fuels," the contents of which are incorporated herein in their entirety.

A "conventional salicylate-based detergent" refers to an alkyl-substituted hydroxyaromatic detergent wherein at least 50% of the alkyl groups by volume are $C_{14}$-$C_{18}$ or less.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, RL, and an upper limit, RU, is disclosed, any number falling within the range is specifically disclosed. In particular, the following numbers within the range are specifically disclosed: $R=RL+k*(RU-RL)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

The lubricating oil compositions, trunk piston engine lubricating oil compositions, and trunk piston engine oils (TPEO) described herein (collectively "lubricating oil compositions") can be used for lubricating any trunk piston engine, marine trunk piston engine, or compression-ignited (diesel) marine engine, such as a 4-stroke trunk piston engine or 4-stroke diesel marine engine.

The lubricating oil compositions have surprisingly been found to be viscosity-stabilized, black sludge-minimizing, low deposit-forming, deposition-reducing, deposit-minimizing, oxidative thermal strain-stabilized, heat-stabilized, detergency-stabilized at elevated temperatures and/or combinations thereof, such as when mixed or combined with a low sulfur marine residual fuel. In this regard, the lubricating oil composition is mixable or combinable with a low sulfur marine residual fuel to form a mixture or system having low, minimal, or no black sludge formation, such as in different temperature regions (e.g., cooling gallery of the pistons, piston ring groove area, combustion chamber, or other cooling regions) of a trunk piston engine or marine trunk piston engine (such as a region having a temperature of about 300° C. or less, about 280° C. or less, about 260° C. or less, about 240° C. or less, about 220° C. or less, about 200° C. or less, about 180° C. or less, about 160° C. or less, about 140° C. or less, about 100° C. or less, about 80° C. or less, about 60° C. or less, or about 40° C. or less. In some preferred embodiments, the lubricating oil compositions reduce black sludge (or black sludge deposit) formation in an engine operating on, using, and/or containing a low sulfur marine residual fuel by at least about 5%, at least about 10% or more, at least about 25% or more, at least about 50% or more, at least about 100% or more, at least about 200% or more, at least about 300% or more, or even at least about 500% or more, when compared to a lubricating oil composition having no detergent other than a conventional salicylate-based detergent. In another preferred embodiment, the lubricating oil compositions form about 5% less, about 10% less, about 25% less, about 50% less, about 100% less, about 200% less, about 300% less, or even about 500% less black sludge, when mixed (such as in an engine) with a low sulfur marine residual fuel, when compared to a lubricating oil composition having no detergent other than a conventional salicylate-based detergent. Reductions in black sludge formation can be measured in any suitable manner, preferably via a Black Sludge Deposit (BSD) Test (such as is in the Test Methods).

In other aspects, some preferred lubricating oil compositions are viscosity-stabilized trunk piston engine lubricating oil compositions. In a preferred embodiment, the lubricating oil compositions have at least about 5%, at least about 10% less, at least about 25%, at least about 50%, at least about 100%, at least about 200%, at least about 300%, or even at least about 500% less oxidation-based viscosity increase, when compared to a lubricating oil composition having no detergent other than a conventional salicylate-based detergent. In another preferred embodiment, the lubricating oil compositions are at least about 5%, at least about 10%, at least about 25%, at least about 50%, at least about 100%, at least about 200%, at least about 300%, or even at least about 500% more stable or stabilized against oxidation-based viscosity increase, oxidative thermal strain, or combinations thereof, when compared to a lubricating oil composition having no detergent other than a conventional salicylate-based detergent. Viscosity stabilization, and stability against oxidation-based viscosity increase, oxidative thermal strain, and combinations thereof, can be measured in any suitable manner, such as via a Modified Institute of Petroleum 48 (MIP-48) test (such as is described in the Test Methods).

The lubricating oil compositions can have any total base number (TBN) that is suitable for use in trunk piston engines. For example, in some embodiments, the lubricating oil compositions have a TBN of at least about 12, at least about 16, at least about 20, at least about 25, at least about 30, at least about 35, at least about 40, at least about 50, or even at least about 60. In other embodiments, the lubricating oil compositions have a TBN less than about 100, less than about 90, less than about 80, less than about 70, less than about 60, less than about 50, or less than about 40. In other embodiments, the lubricating oil compositions have a TBN in the range from about 12 to about 70, such as in a range from about 20 to about 70, a range from about 12 to about 60, a range from about 20 to about 60, a range from about 12 to about 50, a range from about 20 to about 50, a range from about 30 to about 60, a range from about 30 to about 50. The TBN of the lubricating oil compositions can be measured by any suitable method, such as by ASTM D2896.

The lubricating oil composition can have any viscosity that is suitable for use in a trunk piston engine. In one preferred embodiment, the lubricating oil composition has a viscosity of at least about 5, at least about 10, at least about 15, or at least about 20 cSt at 100° C. In another embodiment, the lubricating oil composition has a viscosity of about 5.6-21.9 cSt at 100° C., such as about 5.6-9.3, about 9.3-12.5, about 12.5-16.3, or about 16.3-21.9 cSt at 100° C. The viscosity of the lubricating oil composition can be measured using any suitable method, such as the method of ASTM D2270.

The lubricating oil compositions disclosed herein can be prepared by any method known to a person of ordinary skill in the art for making lubricating oils. In some embodiments, one or more oils of lubricating viscosity can be blended or mixed with one or more detergents. Optionally, one or more other additives (such as one or more dispersant additives) in addition to the one or more detergents can be added. The one or more detergents and optional additives may be added to one or more oils of lubricating viscosity individually or simultaneously. In some embodiments, the one or more detergents and the optional additives (such as dispersant additives) are added to one or more oils of lubricating viscosity individually in one or more additions and the additions may be in any order. In other embodiments, the one or more detergents and optional additives (such as dispersant additives) are added to one or more oils of lubricating viscosity simultaneously, optionally in the form of an additive concentrate. In some embodiments, the solubilizing of the one or more detergents or any solid additives in one or more oils of lubricating viscosity may be assisted by heating the mixture to a temperature from about 25° C. to about 200° C., from about 50° C. to about 150° C. or from about 75° C. to about 125° C.

Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

The lubricating oil compositions described herein can also be used for any suitable method of using a lubricating oil composition. In one preferred embodiment, a method is provided for operating a trunk piston engine operating on a low sulfur marine residual fuel, comprising lubricating the trunk piston engine with any of the lubricating oil compositions described herein. In one preferred embodiment, a method is provided for operating a trunk piston engine, comprising fueling the trunk piston engine with a low sulfur marine residual fuel, and lubricating the trunk piston engine with any of the lubricating oil compositions described herein. In another embodiment, a method is provided for increasing or enhancing the viscosity-stabilizing, black sludge-minimizing, low deposit-forming, deposition-reducing, deposit-minimizing, oxidative thermal strain-stabilizing, heat-stabilizing, detergency-stabilizing at elevated temperatures characteristics or properties of a lubricating oil composition for use in a trunk piston engine. In another preferred embodiment, a method is provided for reducing deposit (such as black sludge) formation in a Trunk Piston engine operating on a low sulfur marine residual fuel, comprising lubricating the engine with any of the lubricating oil compositions described herein. It is preferred, in some embodiments of these methods, for minimal, low, or no black sludge formation (e.g., asphaltene or other deposition) in said engine or trunk piston engine (such as during use or operation of the engine using a low sulfur marine residual fuel, such as in different temperature regions (e.g., cooling galleries of the pistons or other cooling regions) of the engine or trunk piston engine, such as a region having a temperature of about 300° C. or less, about 280° C. or less, about 260° C. or less, about 240° C. or less, about 220° C. or less, about 200° C. or less, about 180° C. or less, about 160° C. or less, about 140° C. or less, about 100° C. or less, about 80° C. or less, about 60° C. or less, or about 40° C. or less.

In other preferred embodiments of the methods, black sludge formation in the engine or trunk piston engine (such as during use or operation of the engine or trunk piston engine using a low sulfur marine residual fuel (such as in lower temperature regions of the engine or trunk piston engine) is reduced by at least about 5%, at least about 10%, at least about 15%, at least about 20%, at least about 30%, at least about 40%, at least about 50%, at least about 60%, at least about 70%, at least about 80%, or even at least about 90%, when compared to a lubricating oil composition having no detergent other than a conventional salicylate-based detergent.

Soap Content of Lubricating Oil Composition

The lubricating oil composition can have any suitable soap content, such as a low soap content, a medium soap content, or a high soap content. In one embodiment, for example, the lubricating oil composition comprises a medium soap content or a high soap content. In another embodiment, the lubricating oil composition comprises a low soap content or a medium soap content. In another embodiment, the lubricating oil composition comprises a low soap content. In another embodiment, the lubricating oil composition comprises a medium soap content. In yet another embodiment, the lubricating oil composition comprises a high soap content.

The "soap" content of a lubricating oil composition refers to the concentration of surfactant that is contributed to the formulation by one or more detergents within the composition. A "low soap" formulation refers to a lubricating oil composition that contains less than 150 mmol of surfactant per 1 kg of lubricating oil composition (i.e., <150 mmol/kg of surfactant). A "medium soap" formulation refers to a lubricating oil composition that contains between 150 mmol and 190 mmol of surfactant per 1 kg of lubricating oil composition (i.e., between 150 and 190 mmol/kg of surfactant). A "high soap" formulation refers to a lubricating oil composition that contains greater than 190 mmol of surfactant per 1 kg of lubricating oil composition (i.e., >190 mmol/kg of surfactant).

As is described more fully with respect to the detergents, the surfactant(s) that are contributed to the lubricating oil composition by the detergent(s) can be any surfactant(s).

Oil of Lubricating Viscosity:

The lubricating oil composition can comprise any suitable oil of lubricating viscosity, such as, for example, any petroleum derived base oil of lubricating viscosity as defined by the American Petroleum Institute (API) Publication 1509, Fourteen Edition, December 1996 (i.e., API Base Oil Interchangeability Guidelines for Passenger Car Motor Oils and Diesel Engine Oils), the contents of which are incorporated herein by reference in their entirety. In one preferred embodiment, the oil of lubricating viscosity is a Group I base oil, a Group II base oil, a Group III base oil, a Group IV base oil, a Group V base oil, or a combination or mixture thereof. The oil, in this regard, can be any blend of two or more base oils having different molecular weights and viscosities, where the blend is processed in any suitable manner to create a base oil having suitable properties, such as the viscosity and TBN values, discussed above) for use in a trunk piston engine. Group I, II and III base oils are mineral oils, each with specific ranges of the amount of saturates, sulfur content and viscosity index. Group IV base oils are polyalphaolefins (PAO). Group V base oils include all other base oils not included in Group I, II, III, or IV. The saturates levels, sulfur levels and viscosity indices for Group I, II, III, IV and V base oils are listed in Table 1 below.

TABLE 1

| Group | Saturates (As determined-by ASTM D 2007) | Sulfur (As determined by ASTM D 2270) | Viscosity Index (As determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than or equal to 0.03% sulfur. | Greater than or equal to 80 and less than 120. |
| III | Greater than or equal to 90% saturates. | Less than or equal to 0.03% sulfur. | Greater than or equal to 120. |
| IV | Defined as polyalphaolefins (PAO) | | |
| V | All other base stocks not included in Groups I, II, III or IV | | |

In one preferred embodiment, the base oil is a Group II base oil, or a blend of two or more different Group II base oils. In another preferred embodiment, the base oil is a Group I base oil, or a blend of two or more different Group I base oils. Suitable Group I base oils include, for example, any light overhead cuts and heavier side cuts from a vacuum distillation column, such as, for example, any Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C.

Detergent:

The lubricating oil composition can comprise any suitable one or more (such as two or more, three or more, or even four or more) detergents, such as any suitable carboxylate-containing detergents. In one preferred embodiment, the one or more detergents comprise an overbased carboxylate-containing detergent, such as an overbased carboxylate metal-containing detergent, or a combination or mixture thereof. An overbased detergent can be any detergent in which the TBN of the additive has been increased by a process such as the addition of a base source (such as lime) and an acidic overbasing compound (such as carbon dioxide).

It is preferred, in some embodiments, for at least 75% (such as at least 80%, at least 85%, at least 90%, at least 95%, or at least 99%) of the alkyl groups contained within the detergent (such as the alkyl groups of a carboxylate-containing detergent, or of an alkyl-substituted hydroxybenzoic acid) to be $C_{20}$ or greater (such as $C_{20}$-$C_{40}$, $C_{20}$-$C_{35}$, $C_{20}$-$C_{30}$, or even $C_{20}$-$C_{25}$). In some embodiments, at least 75% (such as at least 80%, at least 85%, at least 90%, at least 95%, or at least 99%) of the alkyl groups contained within the detergent to be $C_{20}$ or greater (such as $C_{20}$-$C_{40}$, $C_{20}$-$C_{35}$, $C_{20}$-$C_{30}$, or even $C_{20}$-$C_{25}$), with the remainder (such as 25% or less, about 20% or less, 15% or less, 10% or less, 5% or less, or even 1% or less) of the alkyl groups contained within the detergent to be $C_{10}$ or greater (such as $C_{10}$-$C_{20}$, $C_{12}$-$C_{20}$, or even $C_{15}$-$C_{20}$). In one preferred embodiment, the detergent comprises a salt of an alkyl-substituted hydroxybenzoic acid that is derived from an alkyl-substituted hydroxybenzoic acid in which the alkyl groups are the residue of normal alpha-olefins containing at least 90% $C_{20}$ or greater normal alpha-olefins.

In other preferred embodiments, the detergent comprises a carboxylate salt, such as a salt (e.g., an overbased salt) of an alkyl-substituted hydroxybenzoic acid, or even an alkaline earth salt (e.g., calcium or magnesium) of an alkyl-substituted hydroxybenzoic acid. In another preferred embodiment, the one or more detergents comprise an overbased salt (such as an overbased alkaline earth metal salt) of a mixture of alkyl-substituted hydroxybenzoic acid and alkyl-substituted phenol. In another preferred embodiment, the detergent comprises an overbased salt of an alkyl-substituted hydroxybenzoic acid and/or an overbased salt of an alkyl-substituted phenol, in combination or mixture with a non-overbased salt of one or more of: an alkyl-substituted hydroxybenzoic acid and an alkyl-substituted phenol. In another preferred embodiment, the lubricating oil composition comprises one or more detergents comprising an overbased salt of an alkyl-substituted hydroxybenzoic acid and no other overbased salts (other than the salt of the detergent). The detergent, in this regard, can comprise any suitable concentration of anion (e.g., organic anion) associated with the carboxylate salt (or salt of the alkyl-substituted hydroxybenzoic acid).

In another preferred embodiment, the lubricating oil composition comprises a carboxylate-containing detergent that comprises:

(a) a multi-surfactant unsulfurized, non-carbonated, non-overbased, carboxylate-containing additive prepared, for example, according to the method described in Example 1 of U.S. Patent Application Publication No. 2004/0235686, the contents of which are incorporated herein by reference in their entirety; and/or (b) an overbased calcium alkylhydroxybenzoate prepared, for example, according to the method described in Example 1 of U.S. Patent Application Publication No. 2007/0027043, the contents of which are incorporated herein by reference in their entirety.

Some non-limiting examples of suitable metal detergents include sulfurized or unsulfurized alkyl or alkenyl phenates, alkyl or alkenyl aromatic sulfonates, borated sulfonates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

In some preferred embodiments, the lubricating oil composition contains no detergent that does not contain a salt of an alkyl-substituted hydroxybenzoic acid. In other preferred embodiments, the lubricating oil composition does not contain a salt of a sulfonic acid. In other preferred embodiments, the lubricating oil composition does not contain an alkylphenol detergent not containing a salt of an alkyl-substituted hydroxybenzoic acid. In other preferred embodiments, the lubricating oil composition does not contain a salicylate-based detergent. In other preferred embodiments, the detergent of the lubricating oil composition does not contain an alkyl phenate.

As discussed, the detergent can comprise any suitable associated surfactant or detergent, such as any alkylphenol surfactant, any alkyl aromatic surfactant, and/or any alkyl hydroxyaromatic surfactant, such as any alkyl hydroxyaromatic carboxylic acid surfactant and/or any alkyl aromatic sulfonic acid surfactant.

Generally, the amount of the detergent is from about 0.1 wt. % to about 35 wt. %, from about 0.25 wt. % to about 25 wt. %, or from about 0.5 wt. % to about 20 wt. %, based on the total weight of the lubricating oil composition.

Dispersant Additive

The lubricating oil composition may also comprise any suitable dispersant additive ("dispersant") or mixture of multiple dispersants. In one embodiment, the dispersant is an ashless dispersant, such as an ashless dispersant that comprises an alkenyl- or alkyl-succinimide or a derivative thereof, such as a polyalkylene succinimide (preferably, polyisobutene succinimide). In another embodiment, the dispersant is an alkali metal or mixed alkali metal, alkaline earth metal borate, dispersion of hydrated alkali metal borate, dispersion of alkaline-earth metal borate, polyamide ashless dispersant, benzylamine, Mannich type dispersant, phosphorus-containing dispersant, or combination or mixture thereof. These and other suitable dispersants have been described in Mortier et al., "Chemistry and Technology of Lubricants," 2nd Edition, London, Springer, Chapter 3, pages 86-90 (1996); and Leslie R. Rudnick, "Lubricant Additives: Chemistry and Applications," New York, Marcel Dekker, Chapter 5, pages 137-170 (2003), both of which are incorporated herein by reference in their entirety. In a preferred embodiment, the dispersant is a succinimide or a derivative thereof. In another embodiment, the dispersant is a succinimide or derivative thereof which is obtained by reaction of a polybutenylsuccinic anhydride and a polyamine. In another embodiment, the dispersant is a succinimide or derivative thereof which is obtained by reaction of a polybutenylsuccinic anhydride and a polyamine, wherein the polybutenylsuccinic anhydride is produced from polybutene and maleic anhydride (such as by a thermal reaction method using neither chlorine or a chlorine atom-containing compound). In another preferred embodiment, the dispersant is a succinimide reaction product of the condensation reaction between polyisobutenyl succinic anhydride (PIBSA) and one or more alkylene polyamines. The PIBSA, in this embodiment, can be the thermal reaction product of high methylvinylidene polyisobutene (PIB) and maleic anhydride. In another preferred embodiment, the dispersant is a primarily bis-succinimide reaction product derived from PIB having a number average molecular weight (Mn) of about 500-3000, such as about 600-2800, about 700-2700, about 800-2600, about 900-2500, about 1000-2400, about 1100-2300, about 1200-2200, about 1300-2100, or even about 1400-2000. In another preferred embodiment, the dispersant is a primarily bis-succinimide reaction product derived from PIB having a Mn of at least about 600, at least about 800, at least about 1000, at least about 1100, at least about 1200, at least about 1300, at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, at least about 3000. In one preferred embodiment, for example, the dispersant is a primarily bis-succinimide reaction product derived from 1000 Mn PIB, which succinimide in another preferred embodiment is subsequently borated to achieve a boron concentration of about 0.1-3 wt. % (such as about 1-2 wt. %, such as 1.2 wt. %) in the succinimide. In another preferred embodiment, the dispersant is a primarily bis-succinimide reaction product derived from 1300 Mn PIB, which succinimide in another preferred embodiment is subsequently borated to achieve a boron concentration of about 0.1-3 wt. % (such as about 1-2 wt. %, such as 1.2 wt. %) in the succinimide. In another preferred embodiment, the dispersant is a primarily bis-succinimide reaction product derived from 2300 Mn PIB, which succinimide in another preferred embodiment is subsequently reacted with ethylene carbonate.

In another preferred embodiment, the dispersant is a succinimide prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl or alkyl succinimide compound, in this regard, can be derived from a polybutene having a number average molecular weight of about 900-3000, such as about 1000-2500, about 1200-2300, or even about 1400-2100. In some embodiments, the reaction between polybutene and maleic anhydride for the preparation of polybutenyl succinic anhydride can be performed by a chlorination process using chlorine. Accordingly, in some embodiments, the resulting polybutenyl succinic anhydride as well as a polybutenyl succinimide produced from the polybutenyl succinic anhydride has a chlorine content in the range of approximately 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred, in some embodiments, due to the smaller chlorine content in the lubricating oil composition.

In another preferred embodiment, the dispersant comprises a modified alkenyl- or alkyl-succinimide which is after-treated with a compound selected from a boric acid, an alcohol, an aldehyde, a ketone, an alkylphenol, a cyclic carbonate (e.g., ethylene carbonate), an organic acid, a succinimide, a succinate ester, a succinate ester-amide, pentaerythritol, phenate-salicylate and their post-treated analogs or the like, or combinations or mixtures thereof. Preferable modified succinimides are borated alkenyl- or alkyl-succinimides, such as alkenyl- or alkyl-succinimides which are after-treated with boric acid or a boron-containing compound. In another embodiment, the dispersant comprises alkenyl- or alkyl-succinimide that has not been after- or post-treated.

The dispersant can be in any suitable form. In one embodiment, the dispersant is mixed or blended in the lubricating oil composition in the form of a dispersion or suspension comprising any suitable process or diluent oil (such as any Group I oil, Group II oil, or combination or mixture thereof) and the dispersant. In one embodiment, the process or diluent oil is an oil that is different from the base oil (e.g., Group I base oil) of the lubricating oil composition, such as a different Group I base oil, a Group II base oil, or a mixture or combination thereof. In another embodiment, the process or diluent oil is an oil that is the same as the base oil (e.g., Group I base oil) of the lubricating oil composition.

Preferably, the concentration of the one or more dispersants within the lubricating oil composition on an actives basis is less than about 1.0 wt. %, less than about 0.9 wt. %, less than about 0.8 wt. %, less than about 0.7 wt. %, less than about 0.6 wt. %, less than about 0.5 wt. %, less than about 0.4 wt. %, less than about 0.3 wt. %, or even less than about 0.2 wt. %. In other preferred embodiments, the concentration of the one or more dispersant additives within the lubricating oil composition on an actives basis is about 0.1-1 wt. %, about 0.2-0.9 wt. %, 0.1-0.8 wt. %, about 0.2-0.8 wt. %, about 0.3-0.8 wt. %, 0.1-0.7 wt. %, 0.2-0.7 wt. %, about 0.3-0.7 wt. %, about 0.4-0.7 wt. %, about 0.1-0.6 wt. %, about 0.2-0.6 wt. %, about 0.3-0.6 wt. %, about 0.4-0.6 wt. %, about 0.5-0.6 wt. %, about 0.1-0.5 wt. %, about 0.2-0.5 wt. %, about 0.1-0.4 wt. %, 0.2-0.4 wt. %, 0.3-0.6 wt. %, or even about 0.3-0.5 wt. %.

Lubricating Oil Additives

The lubricating oil composition optionally includes any suitable one or more additional modifiers and/or additives (hereinafter designated as "additives") to impart or improve any desirable property of the lubricating oil composition. Some suitable additives have been described in Mortier et al., "Chemistry and Technology of Lubricants," 2nd Edition, London, Springer, (1996); and Leslie R. Rudnick, "Lubricant Additives: Chemistry and Applications," New York, Marcel Dekker (2003), both of which are incorporated herein by reference. In some embodiments, the lubricating oil composition further comprises one or more additives selected from the group consisting of antioxidants, antiwear agents, rust inhibitors, demulsifiers, friction modifiers, multifunctional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations and mixtures thereof. In general, the concentration of each of the additives in the lubricating oil composition, when present, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

In some embodiments, the lubricating oil composition comprises an anti-wear agent, such as to reduce friction and excessive wear. Any suitable anti-wear agent may be used in the lubricating oil composition. Non-limiting examples of suitable anti-wear agents include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "Lubricant Additives: Chemistry and Applications," New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds, zinc diaryl dithiophosphate, or a combination or mixture thereof. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms and may be linear or branched.

The amount of the dihydrocarbyl dithiophosphate metal salt including the zinc dialkyl dithiophosphate salts in the lubricating oil composition disclosed herein may be measured by its phosphorus content. In some embodiments, the phosphorus content of the lubricating oil composition disclosed herein is from about 0.01 wt. % to about 0.12 wt. %, from about 0.01 wt. % to about 0.10 wt. %, from about 0.02 wt. % to about 0.08 wt. %, or from about 0.02 wt. % to about 0.05 wt. % based on the total weight of the lubricating oil composition.

In one embodiment, the phosphorous content of the lubricating oil composition herein is from about 0.01 to 0.08 wt %, such as from about 0.02 to about 0.07 wt. %, from about 0.02 to about 0.06 wt. % or from about 0.02 to about 0.05 wt. % based on the total weight of the lubricating oil composition. In another embodiment, the phosphorous content of the lubricating oil composition herein is from about 0.05 to 0.12 wt % based on the total weight of the lubricating oil composition.

The dihydrocarbyl dithiophosphate metal salt may be prepared by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (II):

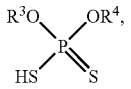

(II)

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (II) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate is derived from only secondary alkyl alcohols, such as a mixture of secondary alkyl alcohols. In further embodiments, the mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In some embodiments, the sulfated ash content of the lubricating oil composition is less than about 5 wt. %, less than about 4 wt. %, less than about 3 wt. %, less than about 2 wt. %, or even less than about 1 wt. %, as measured according to ASTM D874.

In some embodiments, the lubricating oil composition comprises an antioxidant additive, such as to reduce or prevent the oxidation of the base oil. Any suitable antioxidant may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

The lubricating oil composition disclosed herein can optionally comprise a friction modifier that can lower the friction between moving parts. Any suitable friction modifier may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "Chemistry and Technology of Lubricants," 2nd Edition, London, Springer, Chapter 6, pages 183-187 (1996); and Leslie R. Rudnick, "Lubricant Additives: Chemistry and Applications," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any suitable pour point depressant may be used in the lubricating oil composition. Non-limiting examples of suitable pour point depressants include polymethacrylates, alkyl acrylate polymers, alkyl methacrylate polymers, di(tetra-paraffin phenol) phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant Additives: Chemistry and Applications," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any suitable demulsifier may be used in the lubricating oil composition. Non-limiting examples of suitable demulsifiers include anionic surfactants (e.g., alkylnaphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "Chemistry and Technology of Lubricants," 2nd Edition, London, Springer, Chapter 6, pages 190-193 (1996), which is incorporated herein by reference.

The lubricating oil composition disclosed herein can optionally comprise a foam inhibitor or an anti-foam that can break up foams in oils. Any suitable foam inhibitor or anti-foam may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "Chemistry and Technology of Lubricants," 2nd Edition, London, Springer, Chapter 6, pages 190-193 (1996), which is incorporated herein by reference.

The lubricating oil composition disclosed herein can optionally comprise a corrosion inhibitor that can reduce corrosion. Any suitable corrosion inhibitor may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any suitable extreme pressure agent may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "Lubricant Additives: Chemistry and Applications," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any suitable rust inhibitor may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha, omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono oleate, and polyethylene glycol mono oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine molybdenum complex compound, and sulfur containing molybdenum complex compound.

In some embodiments, the lubricating oil composition comprises at least a viscosity index improver. Some non-limiting examples of suitable viscosity index improvers include polymethacrylate type polymers, ethylene propylene copolymers, styrene-isoprene copolymers, hydrated styrene isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. In some embodiments, the diluent oil can have a viscosity from about 13 centistokes to about 35 centistokes at 40° C.

EXAMPLES

The following examples are given as particular embodiments of the invention and to demonstrate the advantages thereof. It is understood that the examples are given by way of illustration and are not intended to limit the specification or the claims that follow in any manner.

Example 1

The efficacy of 12 carboxylate detergent-containing trunk piston engine lubricating oil compositions was compared to the efficacy of 12 salicylate detergent-containing trunk piston engine lubricating oil compositions using a Black Sludge Deposit (BSD) Test as described in the test methods section.

Each of the 24 lubricating oil compositions tested were Group I-based or Group II-based lubricating oil compositions, and contained a mixture of base oils blended to achieve a finished viscosity grade of SAE 40, i.e., a final viscosity of about 14 cSt @ 100° C., and a TBN of 40. The Group I-based lubricating oil compositions contained a major amount of ExxonMobil CORE® 600 basestock (available from ExxonMobil (Irving, Tex.)) and a minor amount of either ExxonMobil CORE® 150 or ExxonMobil CORE® 2500 basestock to achieve the desired final viscosity. The Group II-based lubricating oil compositions contained a major amount of Chevron 600R Group II base stock (available from Chevron Products Co. (San Ramon, Calif.)) and a minor amount of either ExxonMobil CORE® 150 or ExxonMobil CORE® 2500 basestock to achieve the desired final viscosity.

Each of the 24 lubricating oil compositions also contained: (i) either 0.60 wt. % or 0 wt. % (on an actives basis) of a dispersant additive (specifically, a primarily bis-succinimide reaction product of polyisobutenyl succinic anhydride and a mixture of polyalkylene polyamines approximating tetraethylene pentamine, where the polyisobutenyl succinic anhydride was derived from 1000 number average molecular weight ($M_n$) PIB); and (ii) 0.63 wt. % of an oil concentrate of a primary zinc dialkyldithiophosphate. Each of the lubricating oil compositions had a phosphorus content of 0.047 wt. %, and a Zn content of 0.052 wt. %.

Additionally, each of the 24 lubricating oil compositions contained either a carboxylate detergent or a salicylate detergent, and was formulated as either a low soap lubricating oil composition, a medium soap lubricating oil composition, or a high soap lubricating oil composition.

In particular, the low soap carboxylate detergent-containing lubricating oil compositions comprised a mixture of (i) 26.8 wt. % of an unsulftrized, non-carbonated, non-overbased, carboxylate-containing, phenol-distilled detergent containing 5.00 wt-% Ca and having a TBN of 140, prepared according to the method described in Example 1 of US Patent Application 2004/0235686; and (ii) 73.2 wt. % of an overbased calcium alkylhydroxybenzoate detergent containing 12.5 wt-% Ca and having a TBN of 350, prepared according to the method described in Example 1 of US Patent Application 2007/0027043. The treat rate of this detergent in the low soap carboxylate formulations was 13.44 wt. %, resulting in a total soap content of 140 mmol/kg.

The medium soap carboxylate detergent-containing lubricating oil compositions comprised a mixture of (i) 24.4 wt. % of an unsulfurized, non-carbonated, non-overbased, carboxylate-containing, phenol-distilled detergent containing 5.00 wt-% Ca and having a TBN of 140, prepared according to the method described in Example 1 of US Patent Application 2004/0235686; (ii) 18.6 wt. % of an overbased calcium alkylhydroxybenzoate detergent containing 5.35 wt-% Ca and having a TBN of 150, prepared according to the method described in Example 1 of US Patent Application 2007/0027043; and (iii) 57.0 wt. % of an overbased calcium alkylhydroxybenzoate detergent containing 12.5 wt-% Ca and having a TBN of 350, prepared according to the method described in Example 1 of US Patent Application 2007/0027043. The treat rate of this detergent in the medium soap carboxylate formulations was 14.78 wt. %, resulting in a total soap content of 170 mmol/kg.

The high soap carboxylate detergent-containing lubricating oil compositions comprised a mixture of: (i) 71.9 wt. % of an unsulfurized, non-carbonated, non-overbased, carboxylate-containing, phenol-distilled detergent containing 5.00 wt-% Ca and having a TBN of 140 prepared according to the method described in Example 1 of US Patent Application 2004/0235686; and (ii) 28.1 wt. % TBN of an overbased calcium alkylhydroxybenzoate detergent containing 12.5 wt-% Ca and having a TBN of 350 prepared according to the method described in Example 1 of US Patent Application 2007/0027043. The treat rate of this detergent in the high soap carboxylate formulations was 20.02 wt. %, resulting in a total soap content of 290 mmol/kg.

The low soap salicylate detergent-containing lubricating oil compositions comprised a mixture of (i) 19.3 wt. % of a low molecular weight, medium $CO_2$-overbased, primarily mono-alkylated hydroxybenzoate salicylate detergent having a nominal TBN of 170, having alkyl groups that are greater than 95% $C_{14}$-$C_{18}$, and containing 6.0 wt-% Ca; and (ii) 80.7 wt. % of a low molecular weight, highly $CO_2$-overbased, primarily mono-alkylated hydroxybenzoate salicylate detergent having a nominal TBN of 280, having alkyl groups that are greater than 95% $C_{14}$—$Cl_8$, and containing 10 wt-% Ca. The treat rate of this detergent in the low soap salicylate formulations was 15.48 wt. %, resulting in a total soap content of 137 mmol/kg.

The medium soap salicylate detergent-containing lubricating oil compositions comprised a mixture of (i) 52.6 wt. % of a low molecular weight, medium $CO_2$-overbased, primarily mono-alkylated hydroxybenzoate salicylate detergent having a nominal TBN of 170, having alkyl groups that are greater than 95% $C_{14}$-$C_{18}$, and containing 6.0 wt-% Ca; and (ii) 47.4 wt. % of a low molecular weight, highly $CO_2$-overbased, primarily mono-alkylated hydroxybenzoate salicylate detergent having a nominal TBN of 280, having alkyl groups that are greater than 95% $C_{14}$-$C_{18}$ and containing 10 wt-% Ca. The treat rate of this detergent in the medium soap salicylate formulations was 15.48 wt. %, resulting in a total soap content of 155 mmol/kg.

The high soap salicylate detergent-containing lubricating oil compositions comprised a mixture of (i) 62.5 wt-% of a low molecular weight, medium $CO_2$-overbased, primarily mono-alkylated hydroxybenzoate salicylate detergent having a nominal TBN of 170, having alkyl groups that are greater than 95% $C_{14}$-$C_{18}$, and containing 6.0 wt-% Ca; and (ii) 37.5 wt. % of a low molecular weight, highly $CO_2$-overbased, primarily mono-alkylated hydroxybenzoate salicylate detergent having a nominal TBN of 280, having alkyl groups that are greater than 95% $C_{14}$-$C_{18}$, and containing 10 wt-% Ca. The treat rate of this detergent in the high soap salicylate formulations was 19.04 wt. %, resulting in a total soap content of 198 mmol/kg.

The results of the BSD tests for each of the 24 trunk piston engine lubricating oil compositions are set forth in Table 2. Weight percent of dispersant in Tables 2, 3, and 4 are of the active dispersant relative to the total weight of the trunk piston engine lubricating oil composition.

TABLE 2

BSD TEST RESULTS FOR LOW, MEDIUM, AND HIGH SOAP LUBRICATING OIL COMPOSITIONS CONTAINING CARBOXYLATE AND SALICYLATE DETERGENTS

| | | | | | BSD TEST RESULTS | | |
|---|---|---|---|---|---|---|---|
| COMP | SOAP | DETERGENT | BASE OIL | DISPERS'T (wt. %) | mg deposit with high S residual fuel | mg deposit with low S residual fuel | Increase in mg Deposit Relative to Carboxylate with Low S fuel |
| 1 | Low Soap | Carboxylate | Group I | — | 3 | 2 | — |
| 2 | | Salicylate | Group I | — | 77 | 11 | +9 (relative to Comp #1) |
| 3 | | Carboxylate | Group I | 0.6 | 8 | 6 | — |
| 4 | | Salicylate | Group I | 0.6 | 50 | 29 | +23 (relative to Comp #3) |
| 5 | | Carboxylate | Group II | — | 35 | 6 | — |
| 6 | | Salicylate | Group II | — | 106 | 81 | +75 (relative to Comp #5) |
| 7 | | Carboxylate | Group II | 0.6 | 25 | 30 | — |
| 8 | | Salicylate | Group II | 0.6 | 18 | 93 | +63 (relative to Comp #7) |
| 9 | Medium Soap | Carboxylate | Group I | — | 2 | 2 | — |
| 10 | | Salicylate | Group I | — | 79 | 5 | +3 (relative to Comp #9) |
| 11 | | Carboxylate | Group I | 0.6 | 3 | 2 | — |

TABLE 2-continued

BSD TEST RESULTS FOR LOW, MEDIUM, AND HIGH SOAP LUBRICATING OIL COMPOSITIONS CONTAINING CARBOXYLATE AND SALICYLATE DETERGENTS

| | | | | | BSD TEST RESULTS | | |
|---|---|---|---|---|---|---|---|
| COMP | SOAP | DETERGENT | BASE OIL | DISPERS'T (wt. %) | mg deposit with high S residual fuel | mg deposit with low S residual fuel | Increase in mg Deposit Relative to Carboxylate with Low S fuel |
| 12 | | Salicylate | Group I | 0.6 | 60 | 21 | +19 (relative to Comp #11) |
| 13 | | Carboxylate | Group II | — | 2 | 7 | — |
| 14 | | Salicylate | Group II | — | 10 | 96 | +89 (relative to Comp #13) |
| 15 | | Carboxylate | Group II | 0.6 | 53 | 45 | — |
| 16 | | Salicylate | Group II | 0.6 | 84 | 127 | +82 (relative to Comp #15) |
| 17 | High Soap | Carboxylate | Group I | — | 1 | 1 | — |
| 18 | | Salicylate | Group I | — | 4 | 2 | +1 (relative to Comp #17) |
| 19 | | Carboxylate | Group I | 0.6 | 1 | 1 | — |
| 20 | | Salicylate | Group I | 0.6 | 28 | 3 | +2 (relative to Comp #19) |
| 21 | | Carboxylate | Group II | — | 2 | 2 | — |
| 22 | | Salicylate | Group II | — | 142 | 16 | +14 (relative to Comp #21) |
| 23 | | Carboxylate | Group II | 0.6 | 4 | 3 | — |
| 24 | | Salicylate | Group II | 0.6 | 85 | 62 | +59 (relative to Comp #23) |

As is evident from the results illustrated in Table 2, the trunk piston engine lubricating oil compositions containing a carboxylate-containing detergent exhibited a surprisingly less black sludge formation in low sulfur marine residual fuels than the lubricating oil compositions containing a conventional salicylate-based detergent.

Example 2

The degree of stability against oxidation-based viscosity increase was evaluated for each of the 24 trunk piston engine lubricating oil compositions evaluated in Example 1 using a Modified Institute of Petroleum 48 ("MIP 48") test as described in the test methods.

The results of the MIP 48 tests for each of the 24 trunk piston engine lubricating oil compositions are set forth in Table 3.

TABLE 3

MIP-48 TEST RESULTS FOR LUB. OIL COMPS. CONTAINING CARBOXYLATE- AND SALICYLATE-DETERGENTS

| | | | | | MIP-48 TEST RESULTS | |
|---|---|---|---|---|---|---|
| COMP | SOAP | DETERGENT | BASE OIL | DISPERS'T (wt. %) | % viscosity increase | % Increase Relative to the Carboxylate |
| 1 | Low Soap | Carboxylate | Group I | — | 16% | — |
| 2 | | Salicylate | Group I | — | 46% | 30% (as compared to Comp #1) |
| 3 | | Carboxylate | Group I | 0.6 | 9% | — |
| 4 | | Salicylate | Group I | 0.6 | 33% | 24% (as compared to Comp #3) |
| 5 | | Carboxylate | Group II | — | 9% | — |
| 6 | | Salicylate | Group II | — | 34% | 25% (as compared to Comp #) |
| 7 | | Carboxylate | Group II | 0.6 | 6% | — |
| 8 | | Salicylate | Group II | 0.6 | 14% | 8% (as compared to Comp #7) |
| 9 | Medium Soap | Carboxylate | Group I | — | 19% | — |
| 10 | | Salicylate | Group I | — | 37% | 18% (as compared to Comp #9) |
| 11 | | Carboxylate | Group I | 0.6 | 9% | — |
| 12 | | Salicylate | Group I | 0.6 | 23% | 14% (as compared to Comp #11) |
| 13 | | Carboxylate | Group II | — | 8% | — |

TABLE 3-continued

MIP-48 TEST RESULTS FOR LUB. OIL COMPS. CONTAINING CARBOXYLATE- AND SALICYLATE-DETERGENTS

| COMP | SOAP | DETERGENT | BASE OIL | DISPERS'T (wt. %) | MIP-48 TEST RESULTS % viscosity increase | MIP-48 TEST RESULTS % Increase Relative to the Carboxylate |
|---|---|---|---|---|---|---|
| 14 | | Salicylate | Group II | — | 19% | 11% (as compared to Comp #13) |
| 15 | | Carboxylate | Group II | 0.6 | 14% | — |
| 16 | | Salicylate | Group II | 0.6 | 18% | 4% (as compared to Comp #15) |
| 17 | High Soap | Carboxylate | Group I | — | 17% | — |
| 18 | | Salicylate | Group I | — | 21% | 4% (as compared to Comp #17) |
| 19 | | Carboxylate | Group I | 0.6 | 13% | — |
| 20 | | Salicylate | Group I | 0.6 | 22% | 9% (as compared to Comp #19) |
| 21 | | Carboxylate | Group II | — | 19% | — |
| 22 | | Salicylate | Group II | — | 36% | 17% (as compared to Comp #21) |
| 23 | | Carboxylate | Group II | 0.6 | 16% | — |
| 24 | | Salicylate | Group II | 0.6 | 24% | 8% (as compared to Comp #23) |

As is evident from the results illustrated in Table 2, the trunk piston engine lubricating oil compositions containing a carboxylate-containing detergent exhibited surprisingly better stability against oxidation-based viscosity increase than did the lubricating oil composition that contained a conventional salicylate-containing detergents.

Example 3

The degree of high temperature detergency was evaluated for each of the 24 trunk piston engine lubricating oil compositions evaluated in Example 1 using a Komatsu Hot Tube ("KHT") test as described in the test methods.

The results of the KHT tests for each of the 24 trunk piston engine lubricating oil compositions, are set forth in Table 4. As described in the test methods, the test results are presented in the form of numerals between "0" and "10", wherein the value "0" was assigned to glass tubes that appeared black with deposits following the KHT test; the value "10" was assigned to glass tubes that appeared clear from deposits following the KHT test; and the term "blocked" was assigned to glass tubes that appeared blocked with deposits following the KHT test

TABLE 4

KHT TEST RESULTS FOR LUB. OIL COMPS. CONTAINING CARBOXYLATE- AND SALICYLATE-DETERGENTS

| COMP | SOAP | DETERGENT | BASE OIL | DISPERS'T (wt. %) | KHT TEST RESULTS @ 310° C. | KHT TEST RESULTS @ 320° C. | KHT TEST RESULTS @ 330° C. |
|---|---|---|---|---|---|---|---|
| 1 | Low Soap | Carboxylate | Group I | — | 6.5 | 4.5 | 4.5 |
| 2 | | Salicylate | Group I | — | 4.5 | blocked | blocked |
| 3 | | Carboxylate | Group I | 0.6 | 4.5 | 4.5 | 4.5 |
| 4 | | Salicylate | Group I | 0.6 | 6.5 | blocked | blocked |
| 5 | | Carboxylate | Group II | — | 6.5 | 3.5 | blocked |
| 6 | | Salicylate | Group II | — | 6.5 | blocked | blocked |
| 7 | | Carboxylate | Group II | 0.6 | 4.5 | 3.5 | blocked |
| 8 | | Salicylate | Group II | 0.6 | 4.5 | blocked | blocked |
| 9 | Medium Soap | Carboxylate | Group I | — | 6.5 | 6.5 | 4.5 |
| 10 | | Salicylate | Group I | — | 6.5 | blocked | blocked |
| 11 | | Carboxylate | Group I | 0.6 | 6.5 | 6.5 | blocked |
| 12 | | Salicylate | Group I | 0.6 | 6.5 | blocked | blocked |
| 13 | | Carboxylate | Group II | — | 4.5 | 4.5 | blocked |
| 14 | | Salicylate | Group II | — | 4.5 | blocked | blocked |
| 15 | | Carboxylate | Group II | 0.6 | 4.5 | 4.5 | blocked |
| 16 | | Salicylate | Group II | 0.6 | 4.5 | blocked | blocked |
| 17 | High Soap | Carboxylate | Group I | — | 6.5 | 6.5 | 5 |
| 18 | | Salicylate | Group I | — | 6.5 | 5.5 | blocked |
| 19 | | Carboxylate | Group I | 0.6 | 7.5 | 7 | 6.5 |
| 20 | | Salicylate | Group I | 0.6 | 6.5 | 5 | blocked |
| 21 | | Carboxylate | Group II | — | 7.5 | 6.5 | 4.5 |
| 22 | | Salicylate | Group II | — | 4.5 | blocked | blocked |
| 23 | | Carboxylate | Group II | 0.6 | 7.5 | 6.5 | 4.5 |
| 24 | | Salicylate | Group II | 0.6 | 4.5 | blocked | blocked |

As is evident from the results illustrated in Table 4, the trunk piston engine lubricating oil compositions containing a carboxylate-containing detergent exhibited surprisingly better detergency properties at elevated temperatures (as is reflected by their higher assigned values) than did the lubricating oil composition that contained a conventional salicylate-containing detergent, particularly at the higher temperatures of 320° C. and 330° C.

Test Methods

Black Sludge Deposit (BSD) Test

Two samples of a lubricating oil composition were separately mixed with a low sulfur marine residual fuel and with a high sulfur marine residual fuel, to form two test mixtures. The low sulfur marine residual fuel had a sulfur content of 0.97 wt. % and the following properties: a viscosity @ 50° C. of 371 cSt; a viscosity @ 100° C. of 32.4 cSt; an asphaltenes content of 5.15 wt %; a carbon residue content of 13.30 wt. %; a heat of combustion of 42.87 Mj/kg; and a flashpoint of 122.5° C. The high sulfur marine residual fuel had a sulfur content of 2.3 wt. % and the following properties: a viscosity @ 50° C. of 545 cSt; a viscosity @ 100° C. of 42 cSt; an asphaltenes content of 7.41 wt %; a carbon residue content of 15.59 wt. %; a heat of combustion of 42.73 Mj/kg; and a flashpoint of 98.0° C.

Each test mixture above was pumped over a heated steel test plate for a period of time. After cooling and washing, the test plates were dried and weighed. In this manner, the weight of the deposit remaining on the test plates was measured and recorded as the change in weight of the test plate.

Modified Institute of Petroleum 48 (MIP 48) Test

Two samples of lubricating oil composition were heated for a period of time. Nitrogen was passed through one of the test samples while air was passed through the other sample. The two samples were then cooled, and the viscosities of the samples were determined. The oxidation-based viscosity increase for each lubricating oil composition was calculated by subtracting the kinematic viscosity at 100° C. for the nitrogen-blown sample from the kinematic viscosity at 100° C. for the air-blown sample, and dividing the subtraction product by the kinematic viscosity at 100° C. for the nitrogen blown sample.

Komatsu Hot Tube (KHT) Test

A lubricating oil composition is passed through a temperature-controlled glass tube for a period of time by employing a suitable air flow. The glass tube is then cooled and washed, and the color of any lacquer deposition remaining on the inner surface of the glass tube is determined using a color merit rating ranging from 0 to 10 (0=black and 10=clean). In cases in which the glass tubes are completely blocked with deposits, the test result is recorded as "blocked".

All publications and patent applications mentioned in this specification are herein incorporated by reference to the same extent as if each individual publication or patent application was specifically and individually indicated to be incorporated by reference.

It will be apparent to one of ordinary skill in the art that many changes and modification can be made to the disclosures presented herein without departing from the spirit or scope of the appended claims.

What is claimed is:

1. A marine trunk piston engine lubricating oil composition, comprising:

a) at least 40 wt. % of a Group I base oil and/or a Group II base oil; and b) 0.1-35 wt. % of detergent, comprising:

1) at least one overbased detergent comprising an alkaline earth metal salt of an alkyl-substituted hydroxybenzoic acid, wherein at least 90% of the alkyl groups are $C_{20}$ or greater; and 2) at least one non-carbonated, non-overbased detergent comprising an alkaline earth metal salt of an alkyl-substituted hydroxybenzoic acid;

wherein the marine trunk piston engine lubricating oil composition:

A) is a medium or high soap formulation that does not contain:

i) an alkyl-substituted hydroxyaromatic salicylate detergent wherein at least 50% of the alkyl groups by volume are $C_{14}$-$C_{18}$;

ii) a detergent comprising a salt of a sulfonic acid;

iii) an alkyl phenate detergent; and iv) any detergent that does not contain a salt of an alkyl-substituted hydroxybenzoic acid; and B) has at least about 5% less oxidation-based viscosity increase, relative to a lubricating oil composition having no detergent other than a conventional salicylate-based detergent, as measured by a Modified Institute of Petroleum 48 (MIP-48) test.

2. The composition of claim 1, wherein the lubricating oil composition has a Total Base Number (TBN) of at least 20.

3. The composition of claim 1, wherein the alkaline earth metal is calcium.

4. The composition of claim 1, wherein the medium soap formulation comprises between 150 and 190 mmol of surfactant per kg of lubricating oil composition.

5. The composition of claim 1, wherein the high soap formulation comprises greater than 190 mmol of surfactant per kg of lubricating oil composition.

6. The composition of claim 1, wherein the lubricating oil composition reduces black sludge formation in the marine trunk piston engine by at least 25%.

7. The composition of claim 1, wherein the lubricating oil composition has at least about 10% less oxidation-based viscosity increase, relative to a lubricating oil composition having no detergent other than a conventional salicylate-based detergent, as measured by the MIP-48 test.

8. A method for operating a marine trunk piston engine, comprising:

i) fueling the marine trunk piston engine with a low-sulfur marine residual fuel having 1.5 wt. % or less of sulfur, relative to the total weight of the fuel, and ii) lubricating the marine trunk piston engine with the marine trunk piston engine lubricating oil composition of claim 1.

9. A method for lubricating a marine trunk piston engine, comprising:

lubricating the marine trunk piston engine with the marine trunk piston engine lubricating oil composition of claim 1;

wherein the marine trunk piston engine is operating on a low-sulfur marine residual fuel having 1.5 wt. % or less of sulfur, relative to the total weight of the fuel.

10. The composition of claim 1, wherein the composition comprises one or more dispersant additives.

11. The composition of claim 10, wherein the composition comprises about 0.3-0.7 wt. % of the one or more dispersant additives, relative to the total weight of the composition.

12. The composition of claim 10, wherein one or more of the dispersant additives comprises a polyalkylene succinimide.

* * * * *